United States Patent [19]

Bartok

[11] 4,065,129

[45] Dec. 27, 1977

[54] PIN BALL BUMPER MECHANISM WITH ROTATIONAL DRIVE

[75] Inventor: Stephen Bartok, Rancho Palos Verdes, Calif.

[73] Assignee: Ideal Toy Corporation, Hollis, N.Y.

[21] Appl. No.: 747,831

[22] Filed: Dec. 6, 1976

[51] Int. Cl.[2] ..... A63F 7/10

[52] U.S. Cl. ..... 273/121 A; 124/10; 273/129 D

[58] Field of Search ..... 200/61.1, 61.11; 273/119 R, 119 A, 122 R, 122 A, 129 D, 129 R, 121 R, 121 A, 121 D; 124/10

[56] References Cited

U.S. PATENT DOCUMENTS

| | | | |
|---|---|---|---|
| 2,219,934 | 10/1940 | Nelson | 273/119 A |
| 2,830,819 | 4/1958 | Pearl | 273/121 A |
| 3,559,991 | 2/1971 | Immendorf | 273/129 D |
| 3,870,307 | 2/1973 | Meyer et al. | 273/121 A |

*Primary Examiner*—Richard C. Pinkham
*Assistant Examiner*—Lawrence E. Anderson
*Attorney, Agent, or Firm*—Richard M. Rabkin

[57] ABSTRACT

A bumper mechanism is disclosed which is adapted to be mounted in a pin ball machine having a playing surface along which pin balls can be projected. The bumper mechanism comprises first and second bumper elements which define a slot therebetween for receiving pin balls projected on the play surface. One of the bumper elements is mounted for sliding movement between a first position adjacent the other of the bumper elements and a second position remote from the other of the bumper elements, in response to entrance of a pin ball into the slot. Downward movement of the bumper element causes it to engage a drive element rotatably mounted in the pin ball machine so that cooperating means on the drive element and the depressed bumper element engage each other and drive the depressed bumper element back towards its first position adjacent the other bumper element in response to rotation of the drive element. In this manner the pin ball which entered the slot between the bumper elements is squeezed by the bumper elements and projected from the bumper mechanism.

25 Claims, 10 Drawing Figures

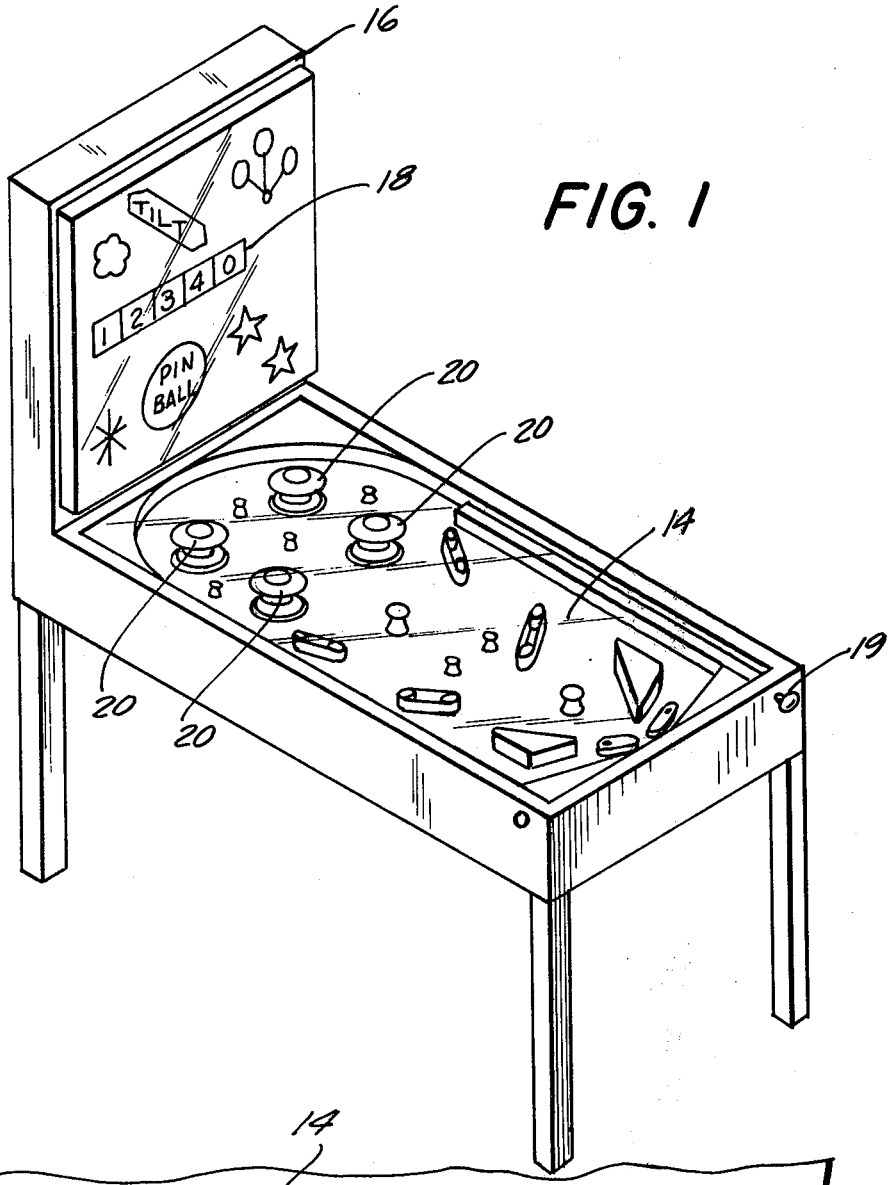
FIG. 1
FIG. 6
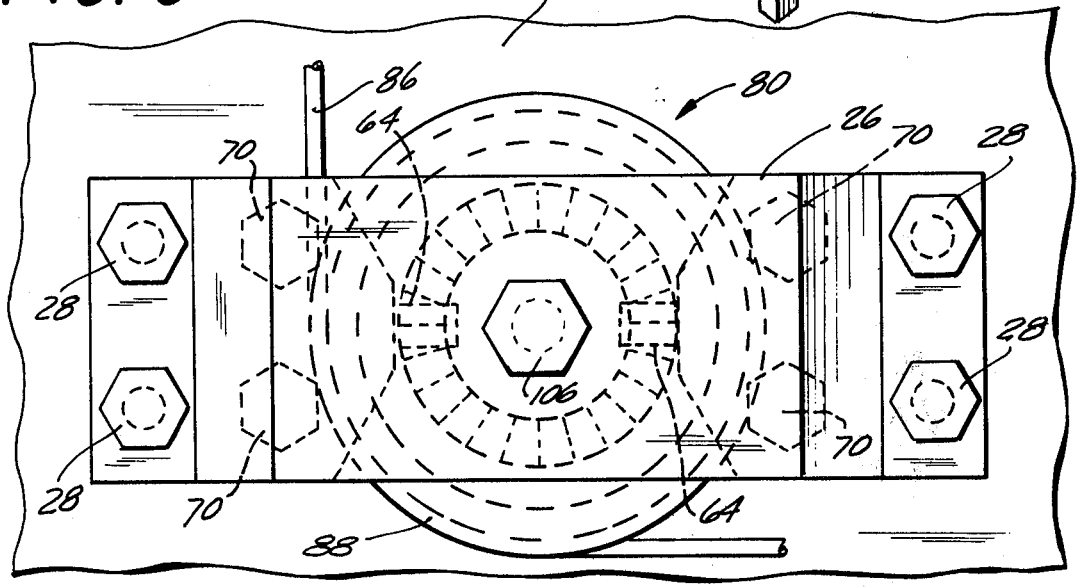

PIN BALL BUMPER MECHANISM WITH ROTATIONAL DRIVE

The present invention relates to bumper mechanisms, and more particularly to a bumper mechanism adapted to be used in a pin ball machine.

A variety of different types of bumper arrangements are used in conventional pin ball machines in order to present obstacles to movement of the pin ball along the play surface and to apply a positive drive force to the ball to project it in different directions along the play surface. One of these bumper mechanisms is sometimes referred to as a "thumper-bumper unit" in which the pin ball enters a slot or groove in the bumper and is squeezed by the bumper to be projected along the play surface.

Conventionally constructed "thumper-bumper-units" usually consist of a pair of rings having cooperating surfaces which define an annular slot therebetween. The lowermost of these rings usually lies flush with the surface of the pin ball machine and it is operatively connected to a switch mechanism which controls a solenoid device. When a pin ball enters the slot of the bumper, the lower ring is depressed causing it to close the contacts of the switch to which it is connected thereby to activate the solenoid. Activation of the solenoid draws the upper ring down towards the lower ring to apply a squeezing force on the pin ball and eject it from the bumper unit.

These conventional electronically controlled bumper units have been generally satisfactory in use for commerical coin operated type pin ball machines. However, the electronic mechanisms, switches and contacts associated therewith require frequent field service in order to maintain proper adjustment and spacing. Thus for commercial units where it is economically feasible to provide regular field service, these units are satisfactory. However, for the non-coin operated type of pin ball machine which is primarily used in the home the feasibility of field service is substantially reduced and it is necessary to provide more simplified moving bumper mechanisms, in order to reduce and/or eliminate the need for periodic servicing of the machines.

Accordingly it is an object of the present invention to provide a movable bumper unit for a pin ball machine which is relatively simple in operation and requires little or no maintenance.

Another object of the present invention is to provide a movable bumper mechanism which is mechanically operated in response to the movement of a pin ball against the bumper, without the need for contact switches and solenoids.

A still further object of the present invention is to provide a pin ball bumper mechanism which is relatively simple in construction and economical to manufacture.

A still further object of the present invention is to provide a movable pin ball bumper mechanism which is durable in use.

In accordance with an aspect of the present invention the bumper mechanism includes a support rod which is adapted to be mounted in a generally vertical position with respect to the play surface of the pin ball machine. A first upper bumper element is mounted on this support rod to cooperate with a second lower bumper element slidably mounted therebelow on the support rod for movement between a position (referred to hereinafter as a first position) adjacent the first bumper element and a second or lower position remote from the first or upper bumper element. The two bumper elements have cooperating surfaces which define a slot therebetween located to receive a pin ball from the play surface of the machine. Resilient means are operatively connected between the support rod and the second bumper element to support the weight of the second bumper element and normally hold it in its first position adjacent the upper bumper element while permitting it to move downwardly to its second position under the influence of the weight of a pin ball entering the slot.

A drive element is provided in the mechanism which is adapted to be rotatably mounted in the pin ball machine adjacent the second position of the lower bumper element. This drive element is rotated by a conventional drive means such as an electric motor and a belt and pulley arrangement. The second bumper element and this drive element have cooperating means which engage each other in the second position of the lower bumper element for driving the second bumper element from that second lower position towards its first position adjacent the first or upper bumper element in response to rotation of the drive element. As a result, when a pin ball enters the slot in the bumper assembly the lower bumper element moves to its second lower position and is driven back towards its first or upper position by the drive element thereby to squeeze the pin ball between the cooperating surfaces of the bumper elements and project it from the bumper onto the play surface of the pin ball machine.

The above, and other objects, features and advantages of this invention will be apparent in the following detailed description of an illustrative embodiment thereof, which is to be read in connection with the accompanying drawings, wherein:

FIG. 1 is a perspective view of a pin ball machine incorporating a plurality of bumper mechanisms constructed in accordance with the present invention;

FIG. 6 is a bottom view of the bumper mechanism taken along line 6—6 of FIG. 3;

Figures 2, 7, 8:
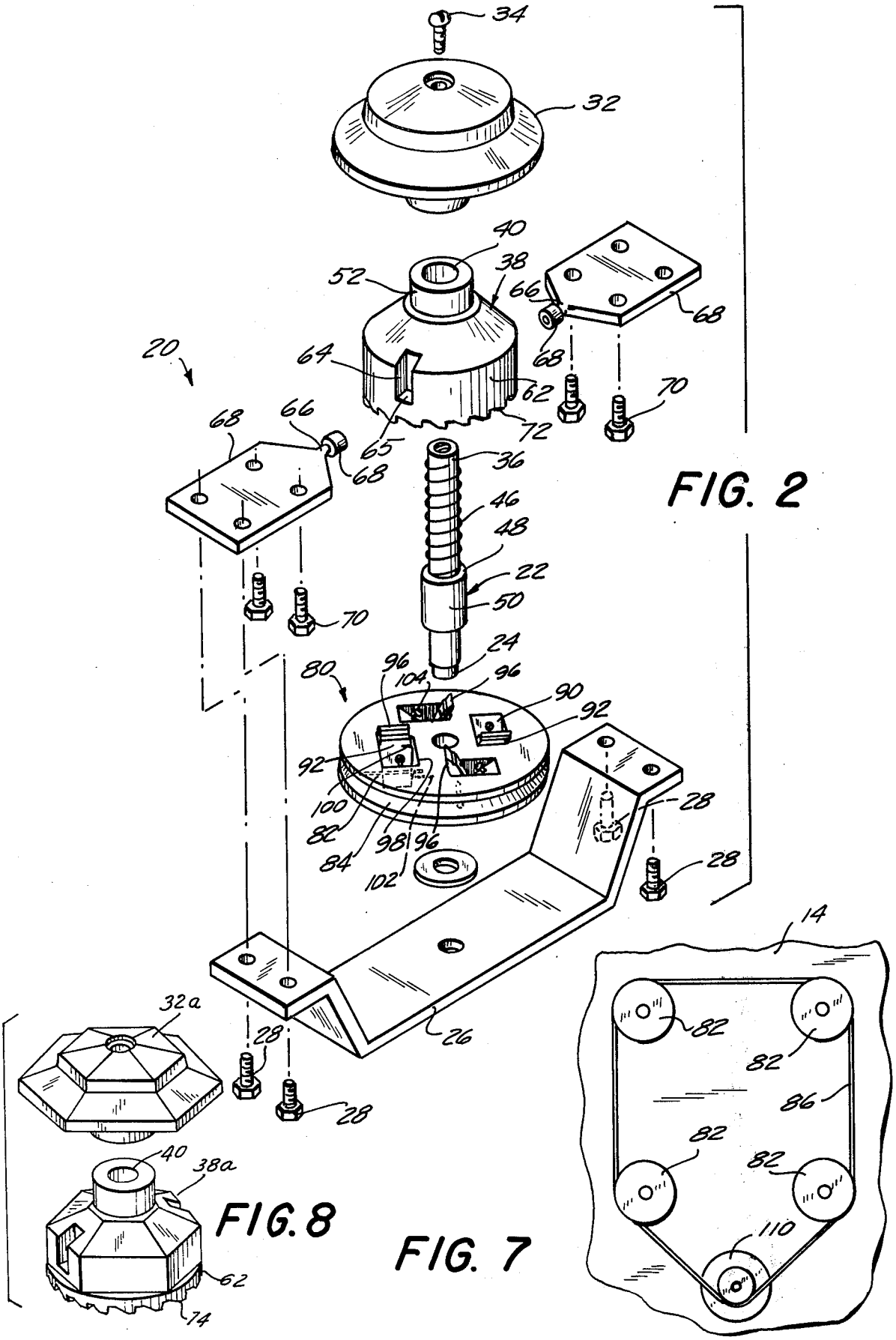
FIG. 2 is an exploded perspective view of the bumper mechanism of the present invention.
FIG. 7 is a schematic bottom view of a portion of the lower surface of the pin ball machine illustrating the drive connection to a plurality of bumper mechanisms constructed in accordance with the present invention.
FIG. 8 is an exploded perspective view of a portion of the bumper mechanism according to another embodiment of the invention.

Referring now to the drawings in detail, and initially to FIG. 1 thereof, a pin ball machine 10, incorporating the bumper mechanisms of the present invention includes a frame 12 that contains a play surface 14 of generally conventional construction. One end of the play surface includes an upstanding back board 16 with a scoring mechanism 18 that accumulates points in response to hits by a pin ball projected onto the play surface with the various targets therein. The pin ball machine includes a projection mechanism 19 of generally conventional construction and a series of obstacles, resilient walls, and bumpers of various types mounted on the play surface 14 in the conventional manner.

In the illustrative embodiment, pin ball machine 10 includes four movable bumper mechanisms or assemblies 20 constructed in accordance with the present invention. These mechanisms are arrayed in a generally rectangular or diamond shaped pattern, but any desirable pattern can be used, and more or less than four such mechanisms or assemblies can be incorporated into a particular model of pin ball machine as desired or necessary.

Figure 3:
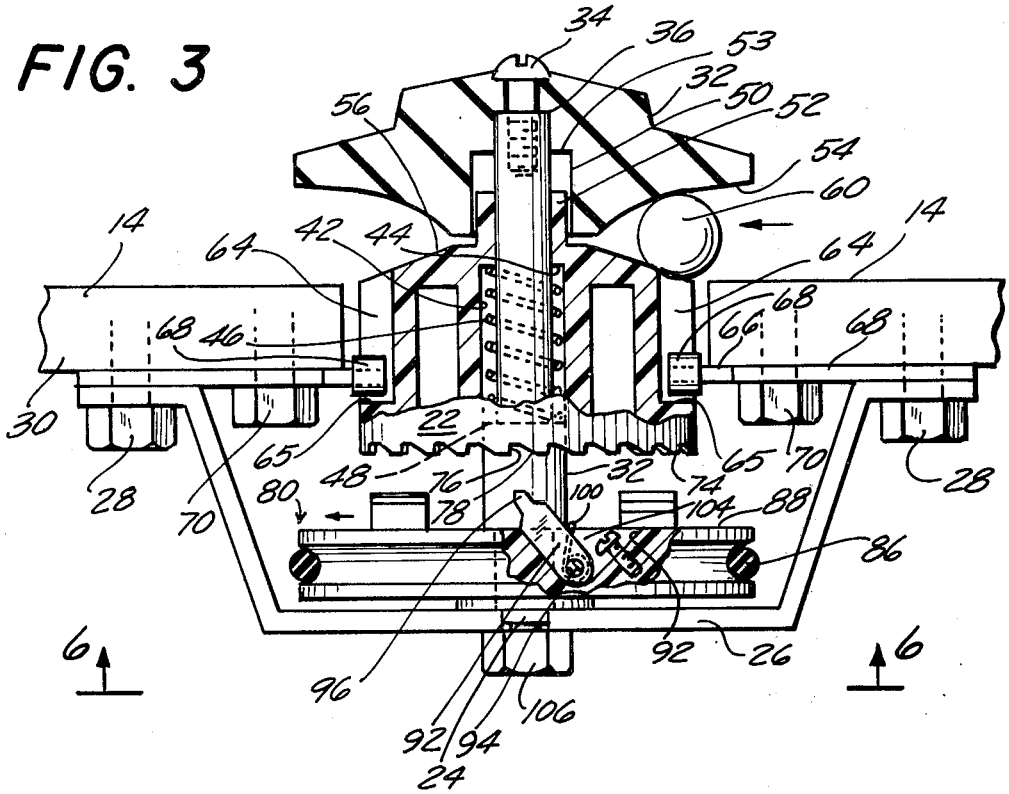
FIG. 3 is a side elevational view, partly in section, showing the assembled configuration of the bumper mechanism as a pin ball enters the mechanism.

Bumper assembly 20 is most clearly illustrated in FIGS. 2 and 3 of the drawing, wherein it is seen that the mechanims includes a support rod or shaft 22 that is mounted at its lower end 24 in a U-shaped bracket 26. The latter is supported by bolts 28 or the like at its free ends on the lower surface 30 of the machine's play surface 14. The end 24 of shaft 22 can either be fixed in bracket 26, or rotatably mounted therein, for reasons more fully described hereinafter.

The bumper, per se, consists of a first or upper bumper element 32 secured by a bolt or screw 34 to the upper end 36 of support rod 22, and a second or lower bumper element 38, having a central bore formed therein slidably receiving upper end 36 of support rod 22, but positioned below bumper element 32. Bumper element 38, as seen in FIG. 3, has an enlarged bore portion 42 which surrounds support rod 22 and defines an annular shoulder 44. A coil spring 46 is captured in this bore with one end engaged against shoulder 44 and its other engaged against a shoulder 48 formed by an enlarged diameter portion 50 of the support rod. This spring is selected to have sufficient spring strength to support the weight of bumper element 38; however, it is substantially non-resistant to any additional force applied to the bumper element against the bias of the spring.

As also seen in FIG. 3, upper bumper element 32 includes an enlarged recess or bore 50 that receives a stem or extension portion 52 of lower bumper element 38. The stem 52 and bore 50 are dimensioned to permit sliding movement therebetween, but stem 52 is short enough so that even in its uppermost position it will not engage the inner end 53 of bore 50.

The two bumper elements have cooperating surfaces 54, 56 respectively, which define an outwardly opening slot 58 therebetween. These surfaces diverge outwardly from one another so that slot 58 has an outwardly divergent cross section, as seen in FIG. 3. The dimensions of the surfaces 54, 56 are selected such that a pin ball 60, projected onto play surface 14 and engaging the bumper assembly 20 will enter slot 58. The weight of the pin ball on the lower bumper element 38 overcomes the bias of spring 46 and depresses the bumper element downwardly.

Lower bumper element 38 includes an annular collar 62 extending downwardly from surface 56. This collar has a pair of side slots 64 formed therein which receives extension pins 66 on brackets 68. The latter are mounted by bolts 70 on the lower surface 30 of play surface 14. The pins or extensions 66 serve to prevent rotation of the lower bumper element 38 during operation of the assembly. To reduce wear it is preferable that these pins have rollers 68 rotatably mounted thereon, so as to permit free vertical sliding movement of the bumper element, while holding the bumper element 38 against rotation. In addition, slots 64 terminate at lower ends 65 located above the lower edge 72 of collar 62, which ends cooperate with rollers 68 to limit the upward movement of element 38 under the influence of spring 46 or the drive arrangement described hereinafter.

The lower edge portion 72 of collar 62 of bumper element 38 includes a plurality of cam teeth 74 formed thereon. These cam teeth have vertical surfaces 76 and inclined ramp surfaces 78 which cooperate with means on a rotary drive element 80 therebelow to drive the lower bumper element 38 upwardly, after it has been depressed by pin ball 60.

Drive element 80, in the illustrative embodiment of the present invention, comprises a pulley or wheel 82 having a peripheral annular groove 84 formed therein which cooperates with a drive belt 86 that is used to rotate the pulley. This drive belt is connected to an electric motor operated substantially continuously when the pin ball machine is in operation. Thus during use of the pin ball machine, or at least when a ball is in play, pulley 82 is rotated. The direction of rotation of the pulley is selected to be in the same direction as the incline of the ramp surfaces 78 on lower bumper element 38.

Pulley 82 includes an upper surface 88 having a plurality of recesses 90 formed therein. Pawl elements 92 are respectively pivotally mounted at their lower ends on pins 94 in recesses 90. These pawls have tapered upper ends 96 extending above surface 88 in order to enter between teeth 74 of lower cam element 38.

Preferably pawls 92 are biased into their down position, illustrated in FIG. 3, by a coil spring 98 which surrounds a portion of pin 94 and has opposed ends 100, 102 respectively engaged with the pawl and inserted in an aperture in the side wall 104 of recess 90. The spring is arranged such that the pawl is inclined in the direction of rotation of pulley 82.

In addition, recess 90 includes a pin or screw mounted, as seen in FIG. 3, to limit pivotal movement of the pawl 92 to a vertical position. In lieu of this pin it is contemplated that recess 90 can be formed with an integral vertical abutment therein.

In the illustrative embodiment of the invention support rod 22 is fixed against rotation in bracket 26 by a bolt 106 secured in its lower end, while pulley 82 is rotatably mounted above the bracket on the support rod. However, it is contemplated that the mounting arrangement for the support rod 22 can be designed to permit rotation of the support rod in bracket 26, with the support rod being fixed to pulley 82 so that the rod also rotates when the pulley is driven. In that case the upper bumper element 32 will rotate with the support rod while the lower bumper element 38 is held against rotation by pins and rollers 66, 68.

Figure 5A:
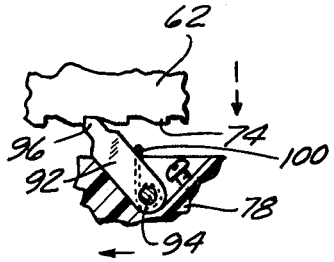
FIGS. 5A, 5B and 5C, are a sequence of drawings illustrating the cooperating elements which engage to drive the lower bumper element upwardly in response to the downward movement illustrated in FIG. 4.
Figure 5B:
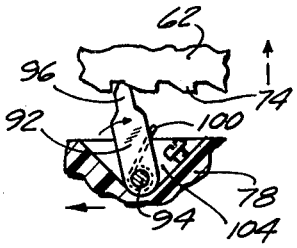
Figure 4:
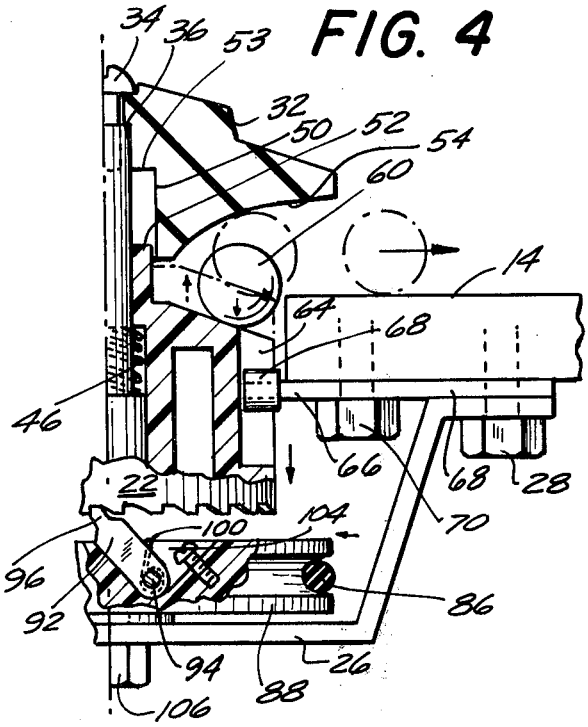
FIG. 4 is a partial sectional view similar to FIG. 3 showing the configuration of the assembly elements when the lower bumper element is depressed under the weight of a pin ball in the slot.

In either event, when a pin ball 60 enters slot 58 in the bumper assembly, the lower bumper element 28 moves downwardly under the weight of the pin ball from the position shown in FIG. 3 (referred to herein as its first position) to a second lower position wherein its lower edge 72 is moved closer to the top surface 88 of pulley 84. When the bumper element 38 moves downwardly its lower edge 72, and in particular the cam teeth 74 thereon, move to the level of the upper edge 96 of the pawl 92, as seen in FIGS. 4 and 5A. The pawl 96 enters between two of the teeth 74 and becomes engaged against the vertical wall 76 of one of the teeth. Since the lower bumper element 38 is held against rotation while pulley 84 is rotating, in the direction of the arrows in FIGS. 5A–5C, this relative movement will cause pawl 92 to pivot on pin 94 against the bias of spring 102. As a result pawl 92 will move from its lower position, shown in FIG. 5A, through the position shown in FIG. 5B to the position in FIG. 5C wherein further pivotal movement (in a clockwise direction in the drawing) is prevented by the pin. As a result of this pivotal movement of pawl 92, the end 96 thereof moves in an upward arc and drives the lower bumper element 38 upwardly against pin ball 60, as seen in FIG. 4, towards the first position of bumper element 38. This reduces the opened slot 58 and squeezes pin ball 60 between surfaces 54, 56 of the bumper elements. This squeezing force, and the outwardly inclined diverging surfaces of the bumper elements, squeeze the ball out of the slot and project it outwardly along play surface 14.

Figure 5C:
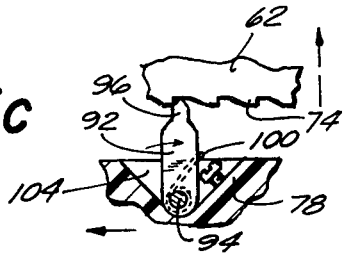

It is noted that once pawl 92 has reached the position shown in FIG. 5C, while further clockwise movement thereof is limited by the pin 94, vertical movement of the lower bumper element 38 is still unrestrained and thus the tooth 76 engaged with the end 96 of the pawl, rides up on the inclined surface 96A of the pawl 96 and continues its upward movement. At about that point ball 60 has been completely ejected from the slot 58, so that lower bumper element 38 continues its upward movement as a result of the momentum imparted to it by the contact between the cam teeth and the pawl element, as well as by the bias of the spring 46.

In the illustrative embodiment of the present invention the bumper element 38 is driven by pawl 92 through the first position of the bumper element shown in FIG. 3 to reduce the size of slot 58 and insure proper squeezing of the ball. The ends 65 of slots 64 will then stop upward movement of the bumper element as a result of its momentum, and then the bumper element will return to its first position shown in FIG. 3 where its weight is balanced by spring 46. However, it is contemplated that the surfaces 65 of slots 64 may be located to hold the bumper element in its first position against the bias of spring 46. That is, in that case, the spring will not simply balance the weight of bumper element 38 but will urge it upwardly so that surfaces 65 normally engage rollers 68 in the at rest position of the bumper rather than being spaced from the rollers as shown in FIG. 3.

Although an illustrative embodiment of the present invention illustrates the use of four pawl elements on the upper surface 88 of pulley 84, each of which may simultaneously act on element 38 when it is depressed by a pin ball, it is contemplated that less than four pawls and even one pawl may be sufficient for use.

In the illustrative embodiment of the invention pin ball machine 10 includes four pin ball assemblies 20 constructed in accordance with the present invention. As seen in FIG. 7, the pulleys 82 of each of the assemblies 20 can be driven by a common electric drive motor 110, through the belt 86. Thus during operation of the machine, all of the pulleys 82 will be simultaneously rotated, although only one of the pin ball assemblies may be activated at any time by the single ball projected on the play surface of the pin ball machine during play of the game.

By this construction of the bumper assembly, relatively few moving parts are required, and the need for continuous maintenace of delicate electrical switches and contacts is eliminated. Accordingly, this assembly is highly satisfactory for use in home type, non-coin activated, pin ball machines. The assembly is durable in construction and relatively simple to manufacture.

In the embodiment of the invention illustrated in FIG. 2 of the drawings the bumper elements 32, 38 are generally circular in plan and define an annular slot therebetween. However, it is contemplated that these elements may have other desirable configurations, and may be polygonal or even straight, in plan. For example, as seen in FIG. 8 bumper elements **32*a*, 38*a* may be hexagonal in plan so that the slot formed therebetween will have six straight sides. These bumper elements are otherwise identical to the bumper elements of FIG. 2, and lower bumper element 38 includes the annular collar 62 and annular array of teeth 74 for cooperating with drive element 80 to drive bumper element 38*a*** upwardly in the manner previously described.

Likewise, the bumper elements 32, 38 can be simply straight or rectangular elements defining a single straight slot therebetween. This type of bumper could be used, for example, along one side of the play surface with the slot opening outwardly towards the play area. Again however the lower bumper element would include the annular collar 62 and teeth 74 extending below the play surface for cooperation with drive element 80.

Although an illustrative embodiment of the present invention has been described herein with reference to the accompanying drawings, it is to be understood that the invention is not limited to that precise embodiment, but that various changes and modifications can be effected therein by one skilled in the art without departing from the scope or spirit of this invention.

What is claimed is:

1. In a pin ball machine having a play surface along which pin balls can be projected, a bumper mechanism including a support bar mounted on said play surface and extending therethrough, said support bar having a lower end portion located below said play surface and an upper end portion located above said play surface; a bumper mounted on said bar including a first upper bumper element secured to the bar and a second bumper element slidably mounted on said bar for movement between a first position adjacent said first bumper element and a second position downwardly on said bar remote from said first bumper element; spring means mounted on said support bar in engagement with said second bumper element to support the weight of said second bumper element and hold it in said first position; said first and second bumper elements defining a slot therebetween substantially at the level of said play surface, said slot being dimensioned to receive a pin ball whereby when a pin ball enters the slot its weight overcomes the biasing force of said spring means and urges said second bumper element downwardly to said second position; said second bumper element including a lower annular edge portion having a plurality of downwardly extending cam teeth formed thereon; a pulley rotatably mounted in said machine below said second bumper element for rotation about an axis aligned with the longitudinal axis of said bar and having an upper surface located adjacent the lower annular edge of the second bumper element in its second position; said pulley having at least one pivotally mounted pawl thereon extending upwardly from its upper surface, and means for rotating said pulley; said pawl being spring biased to normally lie in the direction of rotation of the pulley whereby when said second bumper element is moved to its second position at least one of the cam teeth on said lower annular edge portion thereof is engaged by said pawl and the second bumper element is driven upwardly on said support bar towards said first bumper element whereby said pin ball is squeezed in the slot and driven from the bumper.

2. In a pin ball machine as defined in claim 1 including means for restraining said second bumper element against rotation.

3. In a pin ball machine as defined in claim 2 wherein said bumper elements include outwardly diverging surfaces defining said slot whereby a pin ball in the slot is progressively squeezed and urged outwardly of the slot during upward movement of the second bumper element.

4. In a pin ball machine as defined in claim 3 wherein said pulley is rotatably mounted on said bar and the support bar is mounted in the machine against rotation.

5. In a pin ball machine as defined in claim 3 wherein said support bar is rotatably mounted in said machine for rotation with said pulley; said first bumper element being fixed to said bar for rotation therewith.

6. In a pin ball machine as defined in claim 1 including a plurality of said bumper mechanisms mounted on said play surface.

7. In a pin ball machine as defined in claim 6 wherein said rotating means comprises a common drive train for each of the bumper mechanisms.

8. In a pin ball machine as defined in claim 1 wherein said bumper elements are circular in plan.

9. In a pin ball machine as defined in claim 1 wherein said bumper elements are polygonal in plan.

10. A bumper mechanism adapted to be mounted in a pin ball machine having a play surface along which pin balls can be projected, said bumper mechanism comprising first and second bumper elements defining a slot therebetween, means for mounting one of said bumper elements for sliding movement between a first normal position adjacent the other of said bumpers and a second position remote from the other of said bumpers in response to the entrance of a pin ball into said slot; a drive element adapted to be rotatably mounted in said pin ball machine adjacent said bumper elements, and means for rotating said drive element; said one of said bumper elements and said drive element including cooperating means engaging each other in the second position of said one bumper element for driving said one bumper element from its second towards its first position in response to rotation of said drive element, thereby to squeeze a pin ball in said slot and project it from the bumper.

11. A bumper mechanism as defined in claim 10 wherein said cooperating means comprises at least one pawl member mounted on one of said drive element and said one bumper element and a plurality of cam teeth on the other of said drive elements and said one bumper element respectively positioned to engage each other during rotation of the drive element when said one bumper element moves into its second position.

12. A bumper mechanism as defined in claim 10 wherein said first and second bumper elements have angularly related outwardly diverging surfaces formed thereon defining said slot whereby a pin ball in the slot is progressively squeezed and urged outwardly of the slot during movement of the said one bumper element towards its first position.

13. A bumper mechanism adapted to be mounted in a pin ball machine having a play surface along which pin balls can be projected, said bumper mechanism including a support rod; a first upper bumper element mounted on said support rod; a second lower bumper element slidably mounted on said support rod below said first bumper element for sliding movement between a first position adjacent the first bumper element and a second lower position remote from said bumper element; said first and second bumper elements having cooperating surfaces defining a slot therebetween located to receive a pin ball therein from the play surface of the machine; resilient means operatively connected between said support rod and said second bumper element to support the weight of the second bumper element and normally hold it in its first position while permitting the second bumper element to move to its second position under the influence of the weight of a pin ball entering said slot; a drive element adapted to be rotatably mounted in said pin ball machine adjacent the second position of said second bumper element; and means for rotating said drive element; said second bumper element and said drive element having cooperating means engaging each other in the second position of said second bumper element for driving said second bumper element from its second towards its first position in response to rotation of said drive element whereby when a pin ball enters said slot the second bumper element moves to its second position and is driven back towards its first position by the drive element thereby to squeeze the pin ball between the cooperating surfaces of the bumper elements and project it from the bumper onto the play surface of the pin ball machine.

14. A bumper mechanism as defined in claim 13 wherein the cooperating surfaces on said bumper elements diverge outwardly from one another whereby a pin ball in the slot is progressively squeezed and urged outwardly of the slot during upward movement of said second bumper element.

15. A bumper mechanism as defined in claim 13 wherein said drive element is rotatably mounted on said rod.

16. A bumper mechanism as defined in claim 13 wherein said drive element and said first bumper element are fixed to said rod and said rod is adapted to be rotatably mounted in the pin ball machine whereby the rod and first bumper element rotate with the drive element.

17. A bumper mechanism as defined in claim 13 including means for holding said second bumper element against rotation.

18. A bumper mechanism as defined in claim 17 wherein said cooperating means comprises a plurlity of cam teeth formed on one of said drive element and said second bumper element and at least one pawl pivotally mounted on the other of said drive element and said bumper element located to engage each other in the second position of the second bumper element.

19. A bumper mechanism as defined in claim 18 wherein said drive element is located to rotate on an axis in vertical alignment with said support rod and is positioned below said second bumper element; said drive element having an upper surface and said at least one pawl being mounted on said upper surface.

20. A bumper element as defined in claim 19 wherein said plurality of cam teeth comprise a ring of downwardly facing teeth on said second bumper element.

21. A bumper mechanism as defined in claim 20 including spring means biasing said pivotally mounted pawl to a first lower position adjacent the upper surface of the drive element with the pawl pivoted toward the direction of rotation of the drive element.

22. A bumper mechanism as defined in claim 21 wherein said drive element includes stop means limiting pivotal movement of said pawl against the bias of said spring means to a second substantially vertical position whereby when the second bumper element moves to its second position said pawl engages at least one of said cam teeth, said second bumper element being held against rotation, said pawl thereby being pivoted from its first to its second position by engagement with the cam teeth and rotation of the drive element thereby to drive said second bumper element from its second towards its first position.

23. A bumper mechanism as defined in claim 22 wherein said drive element is a pulley.

24. A bumper mechanism as defined in claim 13 wherein said bumper elements are circular in plan.

25. A bumper mechanism as defined in claim 13 wherein said bumper elements are polygonal in plan.

* * * * *